US007588143B2

(12) United States Patent
Focke et al.

(10) Patent No.: US 7,588,143 B2
(45) Date of Patent: Sep. 15, 2009

(54) PACK WITH TEAR-OPEN THREAD, AND PROCESS AND APPARATUS FOR PRODUCING THE SAME

(75) Inventors: Heinz Focke, Verden (DE); Jurgen Focke, legal representative, Verden (DE); Doris Focke, legal representative, Verden (DE); Martin Stiller, Verden (DE); Gisbert Engel, Luttum (DE); Karsten Krone, Achim-Baden (DE)

(73) Assignee: Focke & Co. (GmbH & Co. KG), Verden (DE)

( * ) Notice: Subject to any disclaimer, the term of this patent is extended or adjusted under 35 U.S.C. 154(b) by 553 days.

(21) Appl. No.: 11/137,496

(22) Filed: May 26, 2005

(65) Prior Publication Data

US 2005/0269220 A1 Dec. 8, 2005

Related U.S. Application Data

(63) Continuation-in-part of application No. 10/489,356, filed as application No. PCT/EP02/10240 on Sep. 12, 2002.

(30) Foreign Application Priority Data

Sep. 14, 2001 (DE) ..... 101 45 412
Dec. 6, 2001 (DE) ..... 101 60 025

(51) Int. Cl.
*B65D 25/00* (2006.01)

(52) U.S. Cl. ..... 206/264; 229/87.05

(58) Field of Classification Search ..... 206/264, 206/271, 273, 265, 260; 229/87.05, 927
See application file for complete search history.

(56) References Cited

U.S. PATENT DOCUMENTS 2,342,646 A * 2/1944 Crommey ..... 206/264
2005/0269220 A1 12/2005 Focke et al.

FOREIGN PATENT DOCUMENTS

| | | | |
|---|---|---|---|
| DE | 88 02 205 | U1 | 4/1988 |
| DE | 297 00 830 | U1 | 3/1997 |
| DE | 297 15 546 | U1 | 1/1999 |
| EP | 343 857 | A2 | 11/1989 |
| EP | 395 249 | A1 | 10/1990 |
| EP | 601 583 | A1 | 6/1994 |
| FR | 2 127 136 | | 1/1972 |
| JP | 56-038075 | U | 4/1981 |
| JP | 56-088668 | U | 7/1981 |
| JP | 58-049789 | U | 4/1983 |
| JP | 02-028419 | U | 2/1990 |
| JP | 02-032943 | A | 2/1990 |
| JP | 04-035561 | U | 3/1992 |
| JP | 04-253655 | A | 9/1992 |
| JP | 08-164926 | A | 6/1996 |
| WO | WO 03 024834 | A1 | 3/2003 |

* cited by examiner

*Primary Examiner*—Jacob K Ackun, Jr.
(74) *Attorney, Agent, or Firm*—Sughrue Mion, PLLC

(57) ABSTRACT

A cuboidal cigarette pack of the hinge-lid-box type (10) is enclosed by an outer wrapper made of film. The latter has a tear-open thread (24) which extends obliquely or diagonally in the region of a front wall (14) and rear wall (15) and merges into side walls (16, 17) via arcuate regions. This allows optimum opening and removal of the outer wrapper with the aid of the tear-open thread (24).

1 Claim, 11 Drawing Sheets

Fig.4
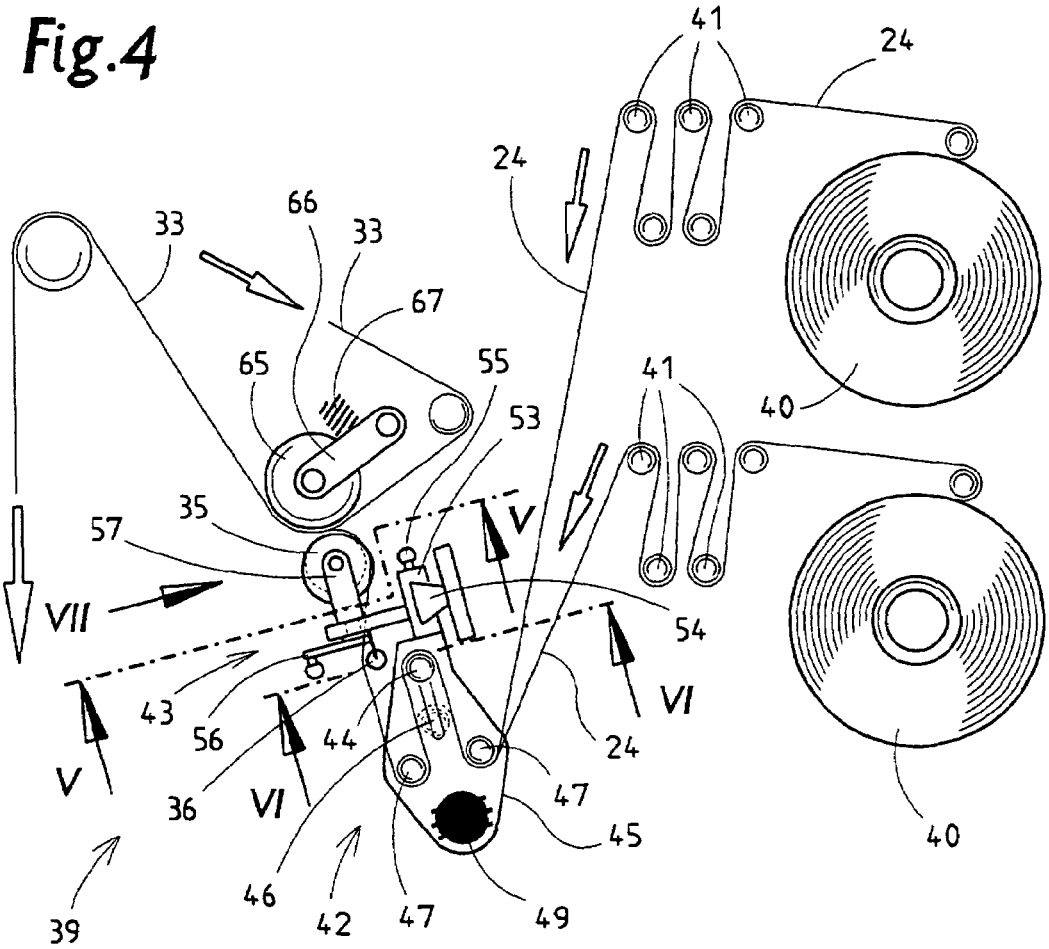
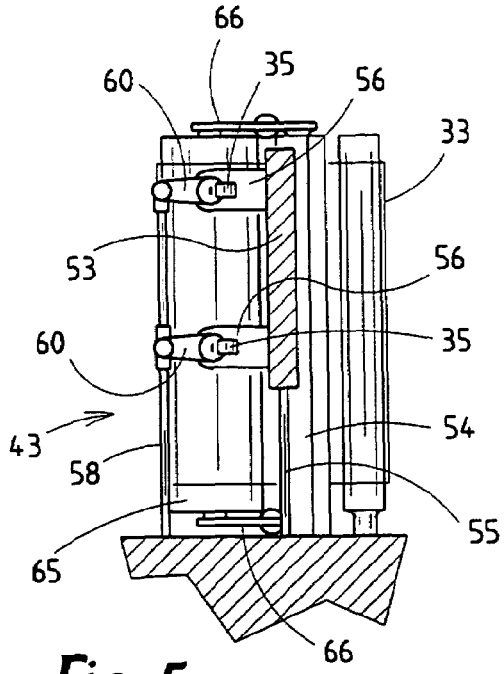
Fig.5
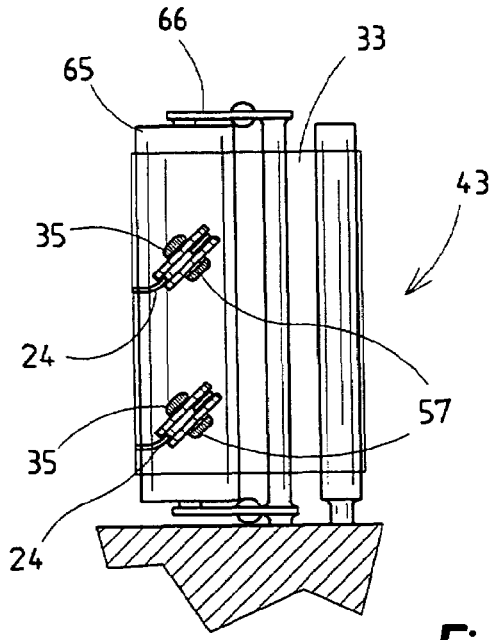
Fig.6

Fig.8
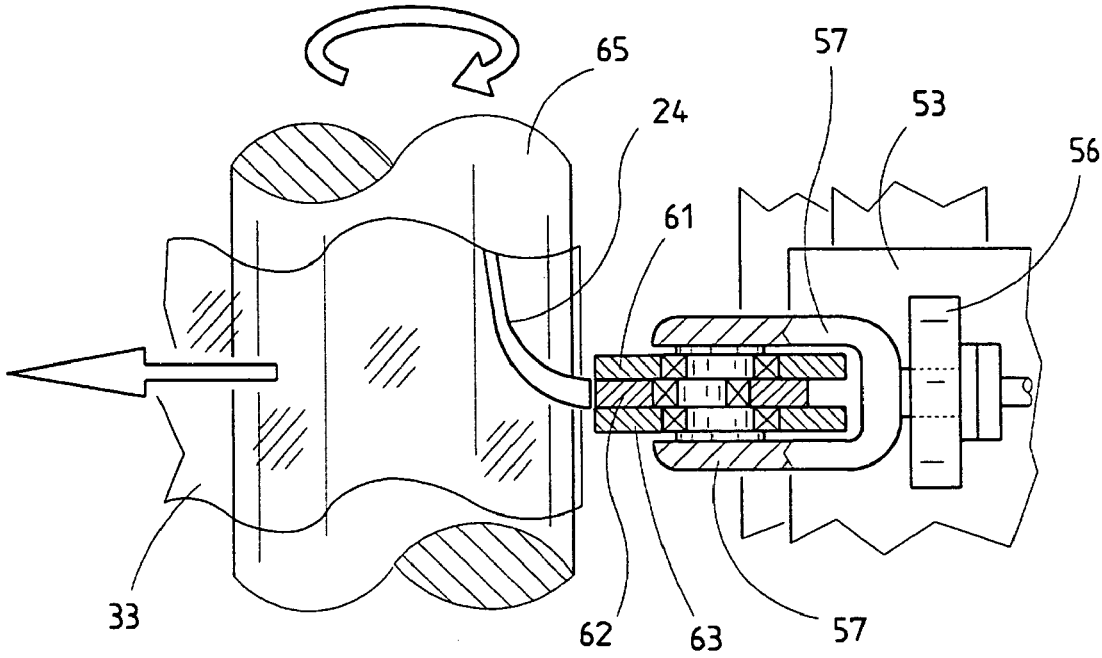
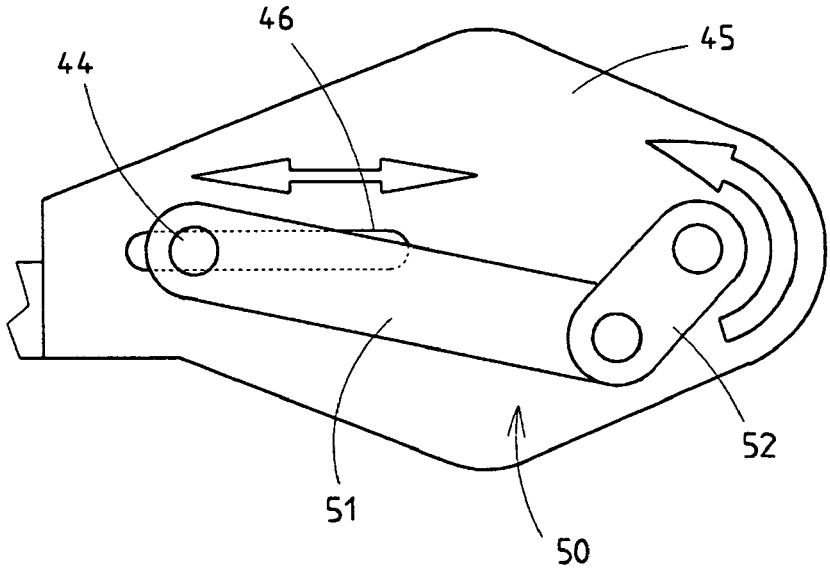
Fig.9

Fig. 16
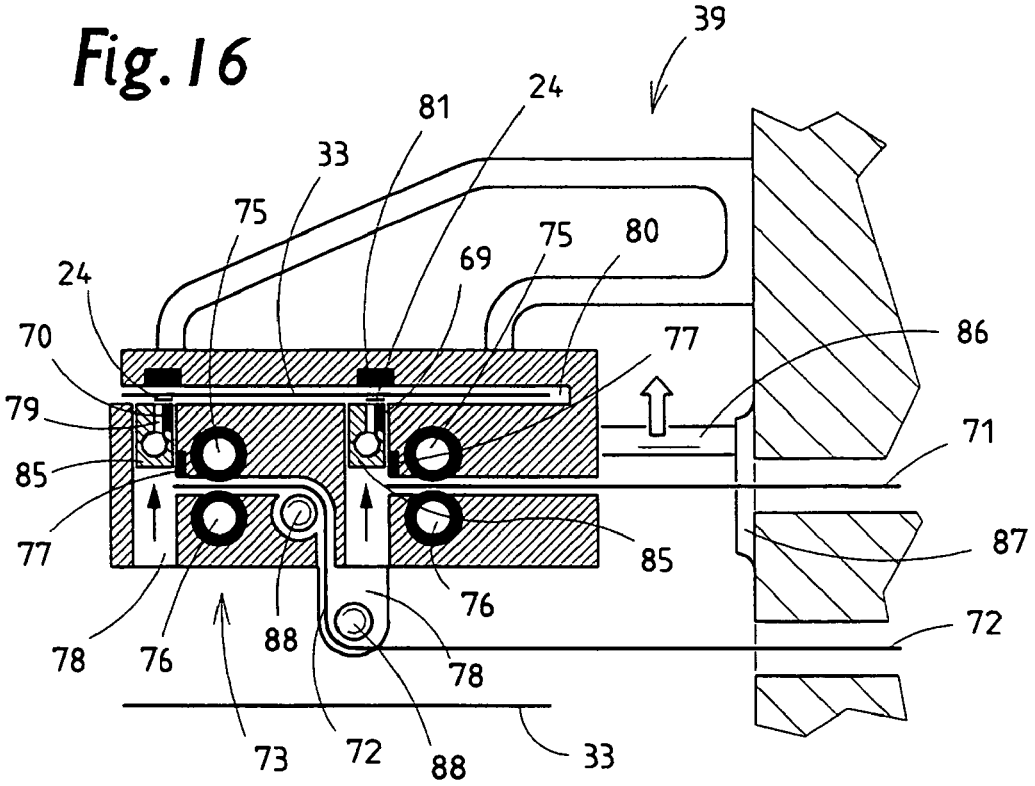
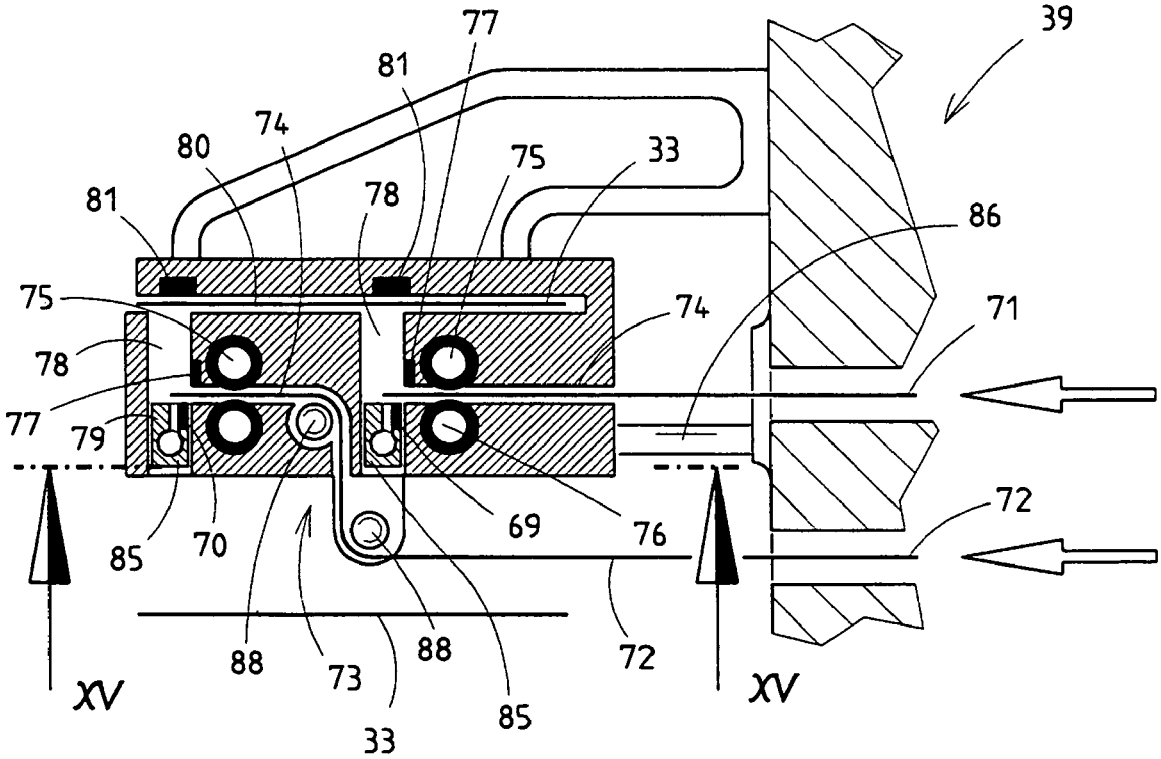
Fig. 17

PACK WITH TEAR-OPEN THREAD, AND PROCESS AND APPARATUS FOR PRODUCING THE SAME

This is a Continuation-in-Part of application Ser. No. 10/489,356 filed Mar. 24, 2005, which is a National Stage Entry, filed on Mar. 12, 2004 of PCT/EP02/10240 filed on Sep. 12, 2002. The entire disclosure of the prior application Ser. No. 10/489,356 is hereby incorporated by reference.

The invention relates to a cuboidal pack, in particular a cigarette pack, with an outer wrapper made of film, and with an open-ended tear-open thread or a weakened line fitted on the outer wrapper. The invention also relates to a process and to an apparatus for producing packaging material configured in the aforementioned manner.

Packs of different shapes and forms are frequently provided, in order to protect the pack contents, with an outer wrapper made of film or of a comparable packaging material. In order to open the pack or the outer wrapper, the latter is frequently provided with a tear-open thread or tear-open strip, which is fastened on the outer wrapper by adhesive bonding or sealing. This outer wrapper can be severed, and thus removed, by virtue of the tear-open thread being gripped at a grip end.

The invention is concerned with such packs, to be precise, in particular with cigarette packs configured as a cuboidal rigid pack (made of thin cardboard).

The object of the invention is to fit a tear-open thread or tear-open strip, or a weakened line, on the outer wrapper of a pack such that, when the tear-open thread or weakened line is actuated, the entire outer wrapper is reliably removed.

In order to achieve this object, the pack according to the invention is characterized in that the tear-open thread or the weakened line, in the region of the large-surface-area front wall and/or rear wall, extends at an oblique or approximately diagonal direction from one (bottom) pack corner to a diagonally opposite (top) pack corner.

The (more or less) diagonal course taken by the tear-open thread or the weakened line in the region of at least one of the large-surface-area pack walls ensures that the outer wrapper is optimally severed when the pack is opened for the first time, with the result that the remaining parts of the wrapper can easily be drawn off from the pack corners. The invention is thus suitable, in particular, for cigarette packs of the hinge-lid-box type with shrink film as the outer wrapper.

A special feature is the weakened line of the outer wrapper, which is configured as a film or the like. This line forms a weakening of the wall thickness of the packaging material while maintaining its tightness. The film can be easily severed in the region of the linear material weakening. As an option, this feature can incorporate a double line, i.e. two parallel weakened lines, which define a material strip of the film that can be stripped away or a single weakened line, which can be severed manually for opening the wrapper.

The tear-open thread or the weakened line is preferably arranged such that a transverse, rectilinear section is formed in the region of the narrow, upright side surfaces, to be precise adjacent to an end wall, on the one hand, and to a base wall, on the other hand, and that, by means of these sections, diagonal sections of the front wall and rear wall, these running in the same direction in each case, are connected to one another.

One special feature is the production of a (film) web with a continuous tear-open thread or tear-open strip, or with a continuous weakened line, and of blanks for outer wrappers. According to a particular embodiment, the tear-open thread or tear-open strip, or the weakened line, is applied to the material web, made of film, paper or the like, during continuous transportation of the same, the tear-open thread being moved by precisely controlled thread guides, in accordance with the thread configuration which is to be produced, transversely to the conveying direction of the (film) web.

According to another important embodiment, thread sections, that is to say tear-open threads or tear-open strips which are completed in terms of shape and length, are applied to the continuous (film) web. The tear-open strips are severed from a thread web by a contoured cut and positioned on the web directly in accordance with the position of a blank for the outer wrapper.

The apparatus according to the invention for applying a continuous tear-open thread or tear-open strip to a continuously moving web has a particular guide element for the tear-open thread, namely with a guide roller. This has a double function, that is to say it serves for positioning the tear-open thread on the web and, at the same time, as a guide element. The guide roller is moved, by a controlled gear mechanism, in the direction transverse to the web or transverse to the conveying direction of the same, with the result that the tear-open thread is transferred onto the web in a curved configuration. It is also the case that the operation of driving the tear-open thread, which is drawn off from a thread reel, is controlled with account being taken of the relative movement between, on the one hand, the web, which is preferably conveyed continuously and at uniform speed, and, on the other hand, the tear-open thread.

The apparatus according to the invention for applying contoured thread sections or complete tear-open threads has a contoured, that is to say curved, severing cutout by means of which in each operating cycle, during a momentary standstill of the web or of a web section, a tear-open thread which is shaped according to the invention is cut off from a transversely fed thread web and positioned precisely on the (film) web, to be precise in the region of a blank which is to be cut off from the latter.

Both processes and apparatuses are expediently set up for double-web operation.

Further details of the pack according to the invention, of the process for producing the outer wrapper, and of the apparatus are explained more specifically hereinbelow with reference to the patent drawings, in which:

FIG. 1 shows a perspective illustration of a pack, namely a cigarette pack, with outer wrapper, FIG. 2 shows a section of a web with applied tear-open thread for producing blanks as outer wrapper, FIG. 3 shows an apparatus, namely packaging machine, for fitting outer wrappers on cigarette packs, FIG. 4 shows a detail of the packaging machine according to FIG. 3, namely a subassembly, for applying tear-open threads to a (film) web, FIG. 5 shows a view, in detail form, of the subassembly according to FIG. 4 along section plane VI-VI, FIG. 6 shows a view, in detail form, of the subassembly according to FIG. 4 along a section plane V-V, FIG. 7 shows a further view of the subassembly according to FIG. 4, this time in the direction of arrow VII, FIG. 8 shows a detail of the illustration according to FIG. 7—region VIII on an enlarged scale, FIG. 9 shows a further detail, this time as a side view, from FIG. 7 in the direction of arrow IX, FIG. 10 shows a simplified illustration, analogous to FIG. 4, of an alternative configuration of the subassembly, FIG. 11 shows a perspective illustration of another embodiment of a pack with outer wrapper, namely a cigarette multipack, FIG. 12 shows a blank for an outer wrapper for the pack according to FIG. 11, FIG. 13 shows a section of a (film) web with prefabricated tear-open threads or strips applied in sections, FIG. 14 shows a side view of a sub-region of an apparatus for producing and applying tear-open threads according to FIG. 13, FIG. 15 shows a detail of the apparatus according to FIG. 14 in horizontal section or in a plan view corresponding to horizontal section XV-XV in FIG. 17, and

FIG. 16 and

FIG. 17 show a detail of the apparatus according to FIG. 14 with elements in different positions, in a vertical section corresponding to section plane XVI-XVI in FIG. 14.

Figure 11:
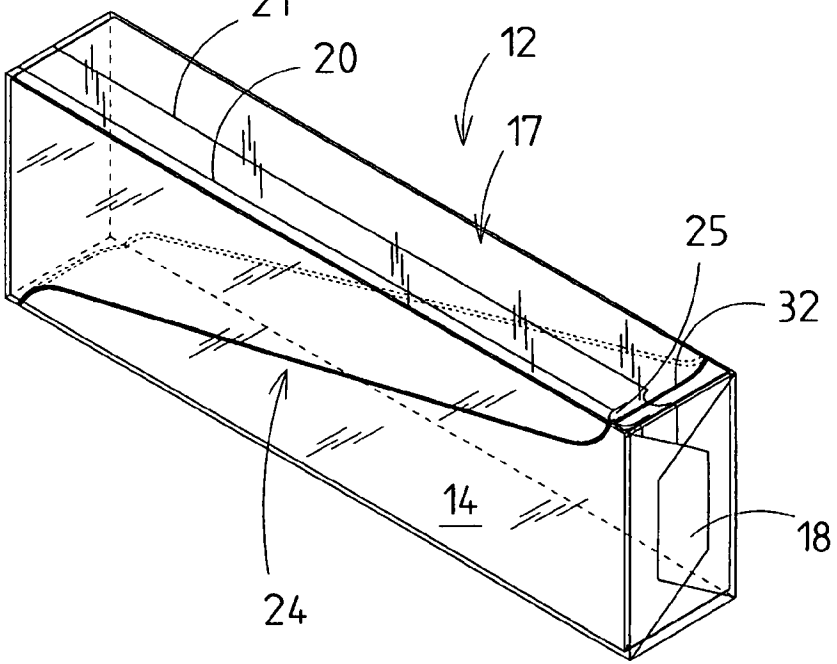

The drawings shows cigarette packs as the preferred application cases, to be precise a hinge-lid box 10 (hinge-lid pack) and a multipack for cigarette packs, namely a cigarette multipack 11 (FIG. 11). The abovementioned packs are rigid packs made of (thin) cardboard and are each enclosed by an outer wrapper. The latter consists of a thin, transparent plastic film, in particular shrink films made of cellophane, although it may also consist of some other packaging material, for example paper.

A blank 12, 13 for forming the outer wrapper comprises a front wall 14, rear wall 15 and side walls 16, 17. The blanks 12, 13 also form end walls 18 and a base wall 19 (hinge-lid box 10). The side wall 16 is positioned as a continuous material strip between the front wall 14 and rear wall 15, while the opposite side wall 17 comprises an outer side flap 20 and an inner side flap 21. The two side flaps 20, 21 overlap one another and are connected to one another by sealing or adhesive bonding. The end wall 18 and base wall 19 comprise end flaps 22, 23 which extend over the entire length of the blank 12, 13.

Figures 1, 2, 13:
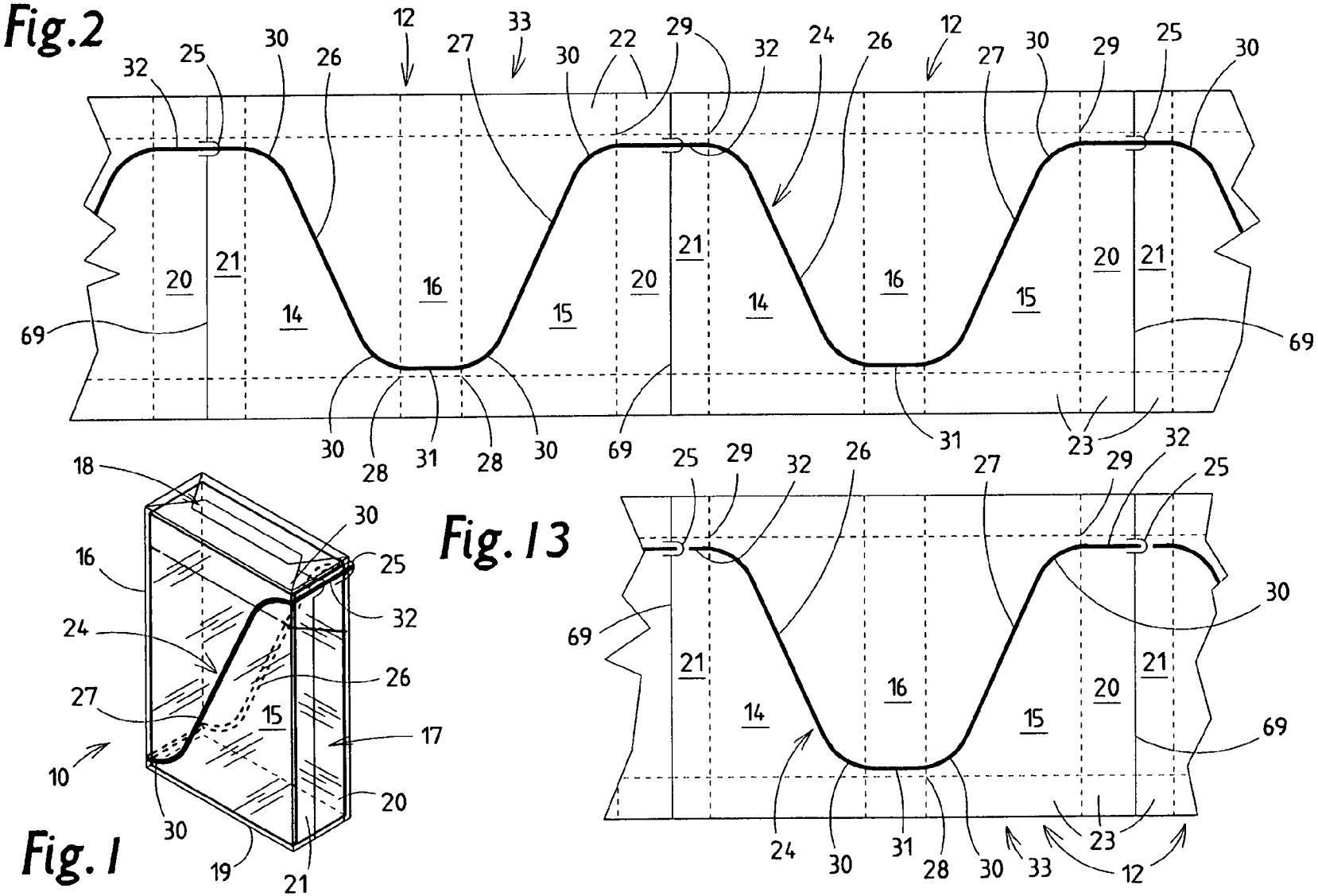

The resulting blank 12, 13, in a first folding step, is folded in a U-shaped manner, as is known, around the pack, namely hinge-lid box 10 or cigarette multipack 11. The side flaps 20, 21, which initially project beyond the pack, are folded one after the other, with partial overlapping (FIGS. 1 and 11). The end flaps 22, 23 are then folded in order to form the end wall 18 and the base wall 19, respectively.

In order to open the pack unit or the outer wrapper, a tear-open thread 24 pursuant to FIG. 1 to FIG. 17 is fitted on the pack or on the outer wrapper thereof. The possibly strip-like tear-open thread 24 is connected, preferably to the inside of the blank 12, 13, by adhesive bonding or sealing. Integrally formed at one end of the open-ended tear-open thread 24 is a grip tab 25 which is formed from the blank 12, 13 and, when the pack is complete, extends at the border of the side wall 17 or the side flap 20 and can thus be gripped by hand. With the aid of this grip tab 25, the tear-open thread 24 can be drawn off, the outer wrapper or the blank 12, 13 being severed in the process.

The tear-open thread 24 is fitted on the blank 12, 13 in a particular configuration, such that the outer wrapper is severed essentially diagonally in the region of the large-surface-area pack sides by the cut-off tear-open thread 24. This allows corner caps of the outer wrapper which are formed to be easily drawn off diagonally.

The (single-piece) tear-open thread 24 is positioned on the blank 12, 13 such that, in the region of the front wall 14, on the one hand, and of the rear wall 15, on the other hand, it follows a more or less diagonal course (in a common imaginary diagonal plane). Accordingly, thread sections 26, 27 extend approximately from one bottom pack corner 28 to the diagonally opposite pack corner 29. In the case of the actual example, the thread section 26, 27 runs at a small distance in each case from the relevant pack corner 28, 29, and thus from the base 19, on the one hand, and the end wall 18, on the other hand. In the region adjacent to these pack corners 28, 29, that is to say at the ends of the thread sections 26, 27 in each case, the tear-open thread forms a rounded portion 30 as a transition into transversely directed, rectilinear thread sections 31, 32. A continuous thread section 31 extends, in the region of the single-piece side wall 16, transversely beyond the latter and directly adjacent to, and above, the base wall 19. The other thread section 32 extends in the top region—adjacent to the end wall 18 and beneath the same—in the region of the side wall 17. This thread section 32 comprises two partially overlapping sub-sections. Accordingly, the tear-open thread is arranged such that its ends overlap. In the region of the outer side flap 20, a grip tab 25 is provided on the segment of the thread section 32.

Figure 3:
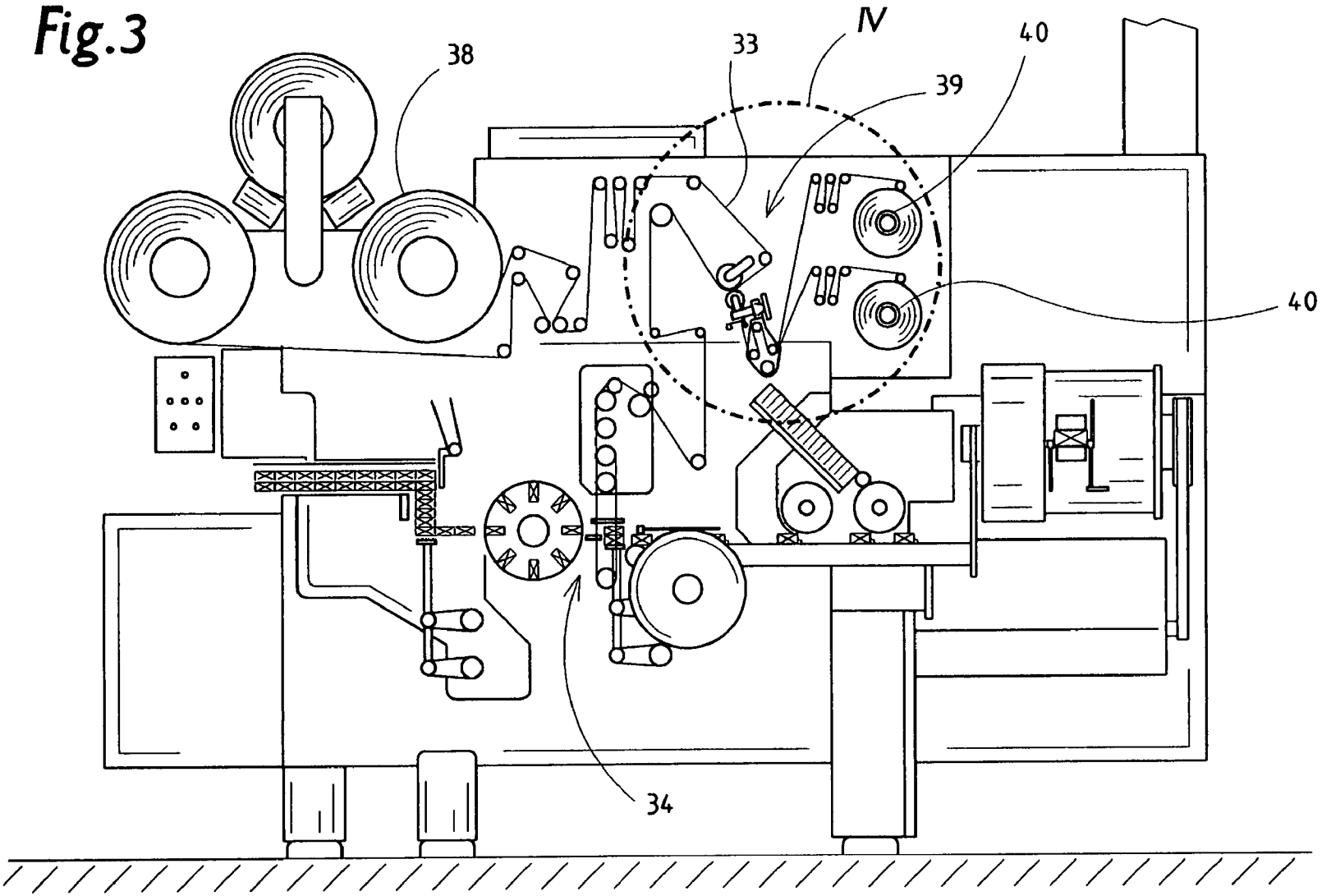

One special feature is the production of the blanks 12, 13 from a continuous web 33, from which blanks 12, 13 are cut off along a severing cut 68 in a blank subassembly 34 of the packaging machine (FIG. 3). The tear-open thread 24 is applied to the continuous web 33, preferably with continuous conveying movement. In this case, the likewise continuously fed tear-open thread 24 is guided, and positioned on the web 33, so as to achieve a more or less meandering or undulating configuration of the tear-open thread 24 (FIG. 2). The resulting thread sections 31, 32, which run in the longitudinal direction of the web 33, are of different lengths. On account of the side flaps 20, 21 located one beside the other, the thread section 32, which is directed toward the end wall 18, is longer than the thread section 31 in the region of the side wall 16.

Figure 12:
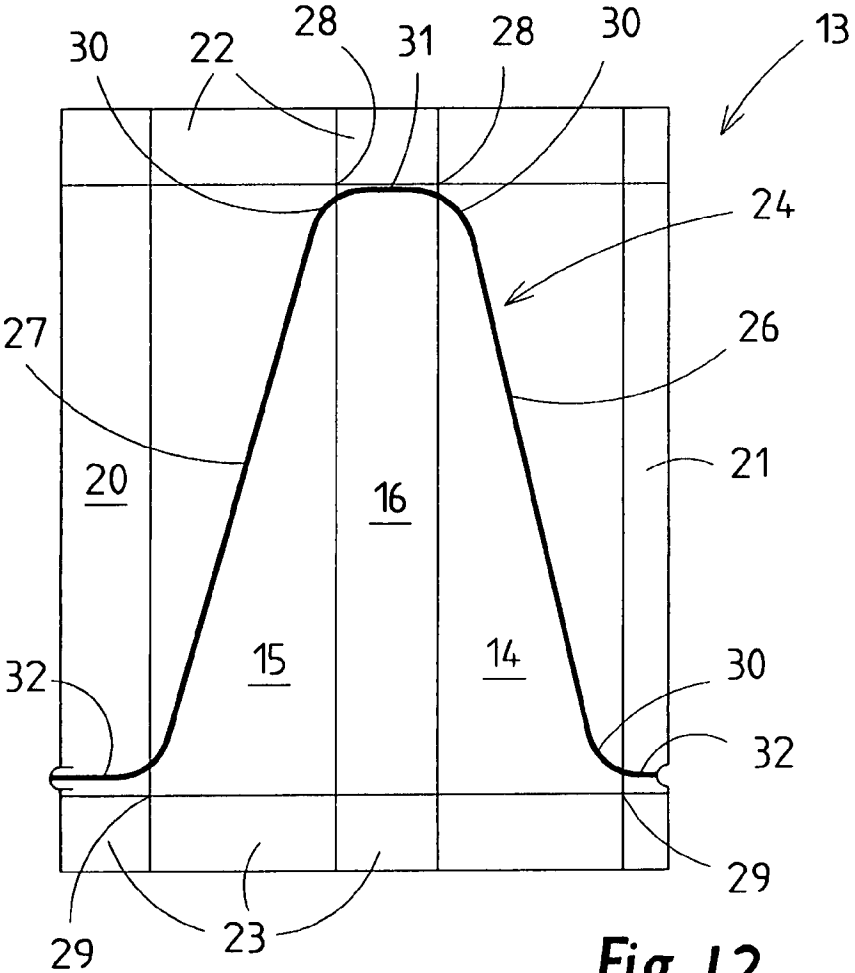
Figure 14:
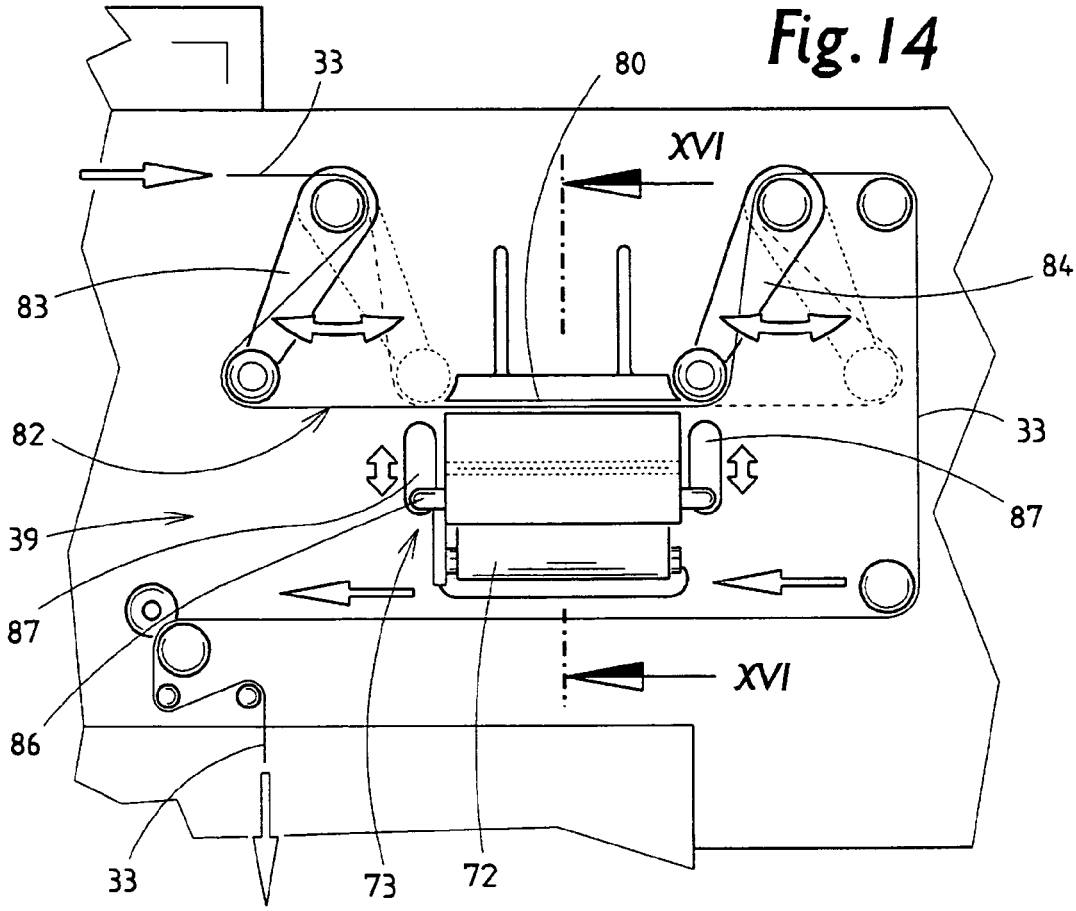
Figure 15:
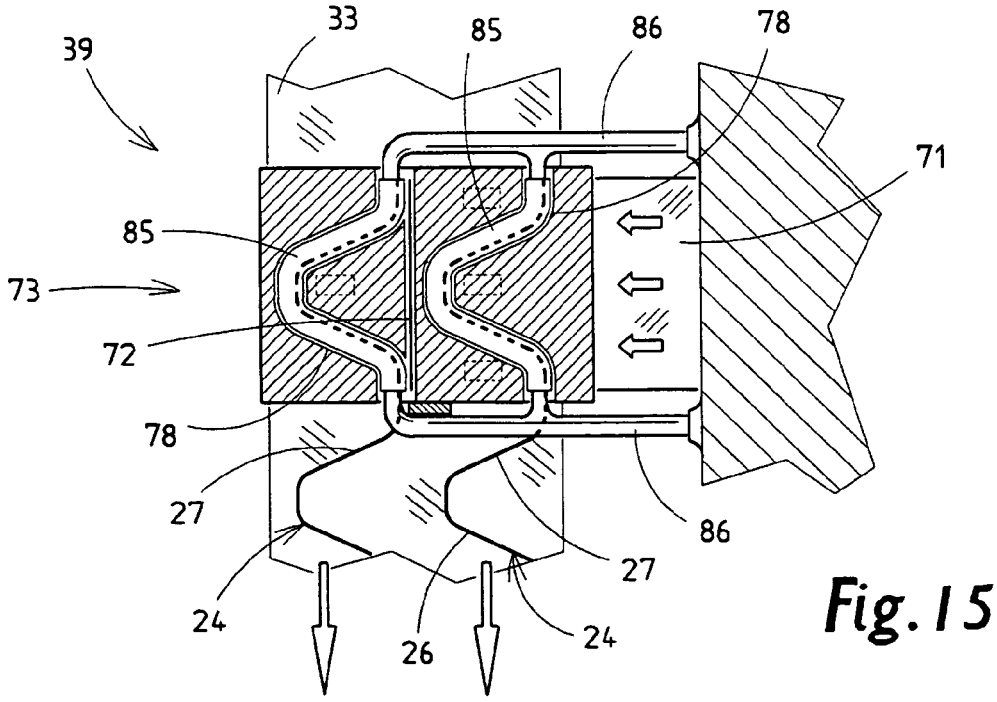

The operation of applying the tear-open thread 24 to the continuous web 33 involves a process-related and equipment-related special feature. The tear-open thread 24 is transferred to the web 33 by a guide element, in the present case by a rotating guide roller 35, the latter being fitted on a mount. The tear-open thread 24 is fed such that a sufficient thread section butts against the circumference of the guide roller 35. The latter can be moved transversely to the continuously conveyed web 33 by a particular, controlled gear mechanism such that the tear-open thread 24 is applied to the web 33 so as to follow a course which is shown in FIGS. 2 and 12 or one which is similar.

An apparatus for applying the tear-open thread 24 to the web 33 is expediently a constituent part of the packaging machine (FIG. 3). The subassembly is indicated as detail IV. Accordingly, the web 33, which is drawn off from reels 38, is fed to a thread unit 39. This is shown, by way of example, in FIG. 4.

The tear-open thread 24 is drawn off from a thread reel 40. The tear-open thread 24 is expediently provided with adhesive on one side, namely on the side which is directed toward the web 33. The thread reel 40 is driven in rotation, to be precise, in the case of this example, with a constant conveying speed of the drawn-off tear-open thread 24. The tear-open thread is guided over compensating rollers 41, which can be moved relative to one another and bring about conveying compensation to the tear-open thread 24 during start-up and stoppage of the packaging machine, that is to say in operating situations which differ from the standard operating procedure.

The actual thread subassembly comprises two gear units 42, 43. The gear unit 42 serves for compensating for the conveying speed of the tear-open thread 24 on account of the relative movement between the web 33 and tear-open thread 24. The gear unit 43 executes the controlled transverse movements of the transfer element, that is to say of the guide roller 35, for the tear-open thread 24.

With a constant drawing-off speed of the tear-open thread 24 in the region of the thread reel 40, the gear unit 42 has to provide an increased conveying speed of the tear-open thread 24 during formation of the thread section 26 and 27. In the region of the thread sections 31 and 32, the conveying speed of the tear-open thread 24 essentially corresponds to that of the web 33.

The gear unit 42 forms an alternating thread-length supply which, at increased conveying speed, is reduced and, at the lower conveying speed, is built up again. This thread supply comprises a thread loop as a result of deflection about a movable dancer roller 44. The latter is fitted in a displaceable manner on a carrier 45, namely in a slot guide 46. Two further, fixed deflector rollers 47, 48 for the tear-open thread are fitted on the carrier 45. The dancer roller 44 is mounted centrally between the deflecting rollers 47, 48, albeit in an offset manner in relation to the same, with the result that, when the dancer roller 44 is displaced, the distance from the deflecting rollers 47, 48 increases or decreases.

The dancer roller 44 is controlled in precise correspondence with the movement sequence of the web 33 and tear-open thread 24. For this purpose, the dancer roller 44 is assigned a servomotor 49 as drive element. This is connected to the dancer roller 44 via a gear mechanism, to be precise via a crank mechanism 50. FIG. 9 shows that side of the carrier 45, with the crank mechanism 50, which is directed away from FIG. 4, a connecting rod 51 being connected to the dancer roller 44. The servomotor 49 acts on a crank 52.

The gear unit 43 controls the movements of the guide roller 35, to be precise doubly so: on the one hand, in respect of the necessary movements of the guide roller 35 transverse to the web 33 and, on the other hand, in respect of the correct angle position of the guide roller 35 such that the latter is aligned with the angle position of the tear-open thread 24 in relation to the web 33.

The guide roller 35 is fitted on a transversely movable carrier, namely on a guide carriage 53, for the transverse movement. This guide carriage can be displaced on a transverse guide 54. Driving takes place via a tie rod 55, which may be driven by a servomotor or is controlled, via a supporting roller, by a cam.

The guide roller 35 is fastened on the guide carriage 53 by way of a carrying component 56, that is to say it is mounted on the carrying component 56 by way of a fork-like, pivotable mount 57. The mount 57 can be rotated or pivoted with the guide roller 35 about an axis, namely transversely to the axis of the guide roller 35. It is thus possible for the guide roller 35 to assume different angle positions. Fitted beneath the carrying component 56 is a pivoting gear mechanism, which comprises a connecting rod 58 which is connected to a pivoting arm 60 of the mount 57 via an articulation 59. It is also the case that the control of the connecting rod 58 is not shown here, and it takes place analogously to the control of the tie rod 55, such that the guide roller 35 is always oriented in the feed direction of the tear-open thread 24. FIG. 6 shows a position of the guide roller 35 during formation of the obliquely directed thread section 26, 27.

The guide roller 35 is of particular design, with the result that it can perform a double function, that is to say, on the one hand, that of guiding the tear-open thread 24 and, on the other hand, that of pressing the same onto the web 33. This is because the guide roller 35 has lateral elevations which do not take effect in the region where the tear-open thread 24 butts against the web 33. For this purpose, the guide roller 35 comprises three individual rollers 61, 62, 63. The central individual roller 62 accommodates the tear-open thread 24 on the circumference, while the lateral individual rollers 61, 63 perform the function of flanged wheels. The individual rollers 61, 62, 63 can be rotated independently of one another and are mounted on a fixed carrying spindle 64 by means of rolling-contact bearings. The carrying spindle 64 comprises offset sections, in a manner similar to a crankshaft. The individual rollers 61, 62, 63 are arranged such that the central individual roller 62 rotates centrally in relation to an imaginary axis, while the lateral individual rollers 61, 63 rotate in an offset manner, with the result that, in the region where the tear-open thread 24 is transferred to the web 33, the individual rollers 61, 62, 63 always have their circumferential surfaces aligned in a circumferential plane (FIG. 8).

In order that the tear-open thread 24 achieves a sufficient region of wrap around the guide roller 35, a supporting roller 36 is fitted beneath the guide roller, namely beneath the carrying component 56, and deflects the tear-open thread 24 to a slight extent, and guides it, in relation to the guide roller 35.

The conveying movement of the tear-open thread 24 in the region of transfer to the web 33 is achieved by the conveying speed of the web 33. The latter draws along the tear-open thread 24 with it as a result of the adhesive connection. The transfer of the tear-open thread 24 to the web 33 takes place in the region of a deflecting roller 65 of the web 33. The guide roller 35 butts against the same. The deflecting roller 65 is mounted in an elastic manner, namely on a pivoting arm 66, which is loaded in the direction of the guide roller 35 by a compression spring 67.

Figure 10:
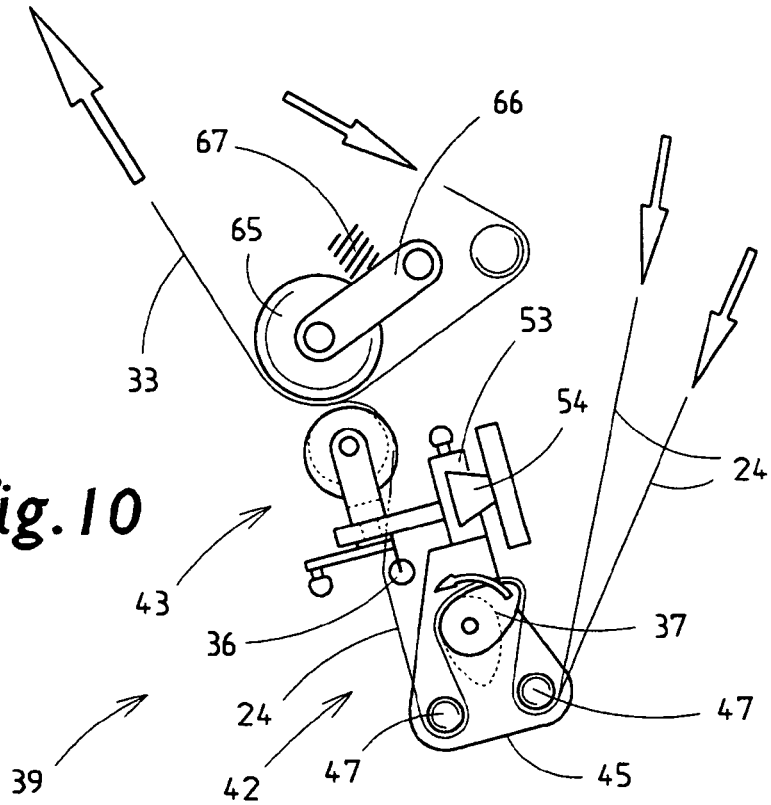
Figure 7:
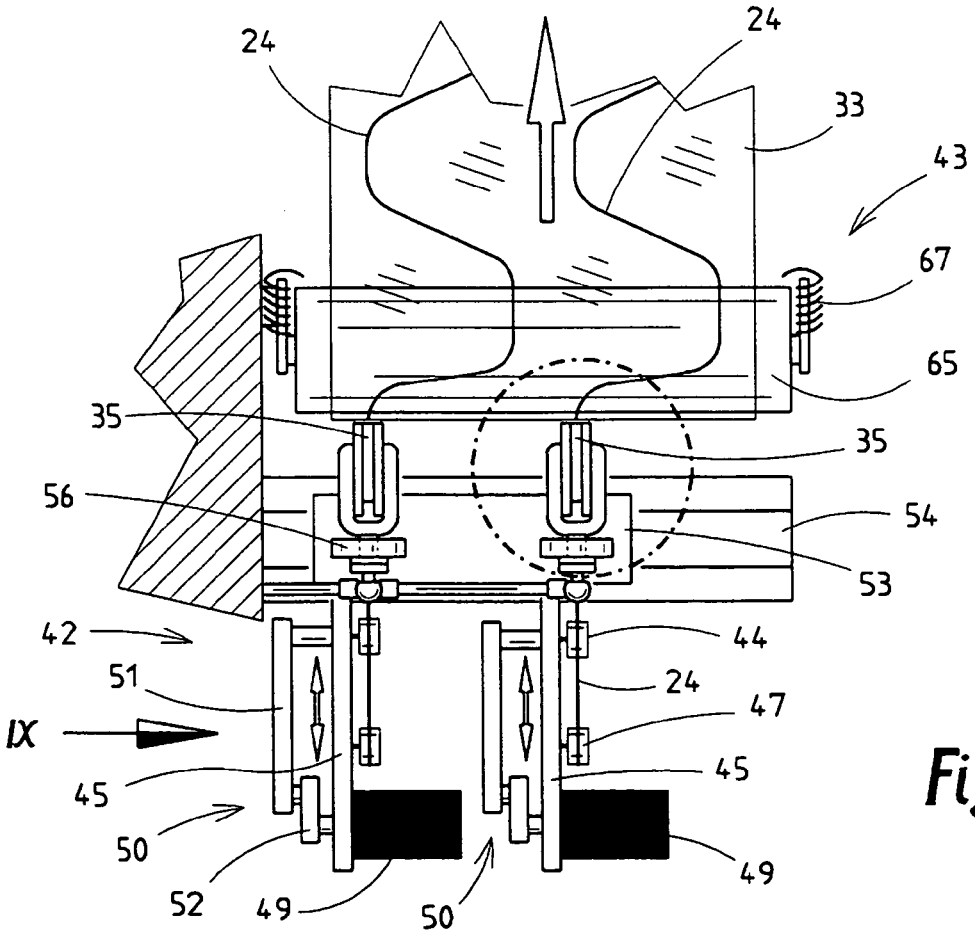

FIG. 10 shows an alternative to the thread unit 39 according to FIG. 4. The gear unit 43 here corresponds to the embodiment according to FIG. 4. A modification has been made in the region of the gear unit 42. The dancer roller 44 with servodrive is replaced by a compensating element which exclusively rotates. This rotating compensating disk 37, the tear-open thread 24 butting against its circumference, as a result of its eccentric shape, during each revolution, brings about length compensation in accordance with the different conveying speeds of the tear-open thread 24.

In the case of the present example, the packaging machine and its subassemblies are set up for double-web operation. The (double-width) web 33 comprises two blank webs. Accordingly, the thread unit 39 is set up for the operation of fitting two tear-open threads 24 at the same time. Correspondingly, two identically equipped thread reels 40 are also provided, that is to say are arranged one above the other. The rest of the elements of the thread unit 39 and/or of the gear units 42 and 43 are set to processing of the two tear-open threads 24 either by appropriate dimensioning or by being provided in a double arrangement. In particular, two guide rollers 35 are thus provided, these being actuated and/or adjusted simultaneously by common elements.

The cigarette multipack 11 according to FIG. 11 is produced in an analogous manner to the hinge-lid box 10 as far as the outer wrapper is concerned. The blank 12 (FIG. 12) is designed such that the obliquely directed thread sections 26, 27 have a proportionally greater length in relation to the thread sections 31, 32. Otherwise, the outer wrappers are of corresponding design.

It is also possible for the tear-open thread 24 or tear-open strip to be produced in sections and fed to an individual blank 12 or the web 33 made of film or the like (FIGS. 13 to 17). In this case, respectively complete tear-open threads 24 are produced and positioned on the web 33. In the case of the exemplary embodiment of FIG. 13, the individual tear-open threads 24 have the same contour as in the exemplary embodiment according to FIGS. 1 and 2. However, the tear-open thread has part of the thread section 32 extending into the grip tab 25. Another end of the thread section 32 is spaced apart from the grip tab 25 of the adjacent blank 12, with the result that the tear-open thread 24, overall, is fitted in an offset manner on the blank 12.

Since the tear-open thread 24 of the present contour is produced in complete form, other configurations are also possible, in particular without rounded portions 30, that is to say, for example, in zigzag form or with different corners.

The thread unit 39 for producing and fitting tear-open threads 24 in FIG. 13 operates with (at least) one severing cutter, namely a thread cutter 69, 70, for cutting off a contoured tear-open thread 24 from the leading end of the material web, namely of a thread web 71, 72. The thread cutter 69, 70 corresponds in shape to that of the tear-open thread 24 which is to be cut off, that is to say, in the present case, it is approximately V-shaped or of meandering form.

The thread web 71, 72 is fed to a cutting block 73 of the thread unit 39 transversely to the web 33. The thread cutter 69, 70 can be moved up and down within the cutting block 73. A leading end of the thread web 71, 72 is held ready as a projection, corresponding to the width of the tear-open thread 24 which is to be cut off, within the cutting block 73. The thread web 71, 72, within the cutting block 73, runs in a slot-like guide 74 and/or between a top and bottom guide roller 75, 76. For the severing cut, the thread cutter 69, 70 is moved upward out of a bottom, starting position (FIG. 17). Formed above the thread web 71, 72 is a fixed mating cutter 77, which has the same contour as the thread cutter 69, 70. The severing cut is executed as a result of the relative movement, a tear-open thread 24 thus being cut off as the leading end of the thread web 71, 72.

The thread cutter 69, 70 feeds the cut-off tear-open thread 24, as (upward) movement continues, directly to the web 33 and positions the tear-open thread 24 on the underside of the web 33 and presses it against the same (FIG. 16). For this purpose, the thread cutter 69, 70 is designed as a (shaped, contoured) carrier or bar 85 which can be moved up and down in an upright, likewise contoured recess 78 of the cutting block 73. In order to retain the tear-open thread 24, the bar 85 is provided with suction bores 79 on the top side adjacent to the thread cutter 69, 70. The suction bores 79 are connected to a negative-pressure source at least during the transporting phase of the tear-open thread 24.

The web 33 is conveyed throughout the cutting block 73 in a (top) guide slot 80. On the side located opposite to the severing cutter 69, 70, an (elastic) pressure-exerting component 81 is formed in the cutting block 73 as an abutment when the tear-open thread 24 is pressed on. The pressure-exerting component 81 may be heated in order for the tear-open thread 24 to be attached by sealing.

It is also the case with this exemplary embodiment that the web 33 is conveyed continuously. A web section 82 in the region of thread unit 39 and/or of the cutting block 73, however, is controlled such that a temporary standstill takes place, that is to say as the tear-open thread 24 is being fitted. For this purpose, the web 33 is guided via two pivotably mounted compensating pendulum arrangements 83, 84 which can be moved back and forth synchronously. This mechanism, which is known per se, brings about a momentary standstill of the web section 82 despite essentially continuous driving operation.

The contoured bars 85 as carriers of the thread cutters 69, 70 have their ends fitted on a (horizontal) carrying arm 86 in each case. The latter is mounted in a machine framework and can be moved up and down in a slot 87, in order to allow the operation of severing the tear-open strip 24 and of feeding the same to the web 33.

The apparatus which is illustrated in FIGS. 14 to 17 is likewise set up for two-web operation. Accordingly, two thread webs 71, 72 are fed to a correspondingly designed cutting block 73, to be precise in a manner in which they are arranged one above the other. The top thread web 71 is led directly into the cutting block 73, while the bottom thread web 72 initially runs beneath the cutting block 73 and is subsequently directed upward, via deflecting rollers 88, and then into a horizontal plane. The web 33 is a double width, with the result that in each case two blanks 12 are located one behind the other in the transverse direction.

Figure 18:
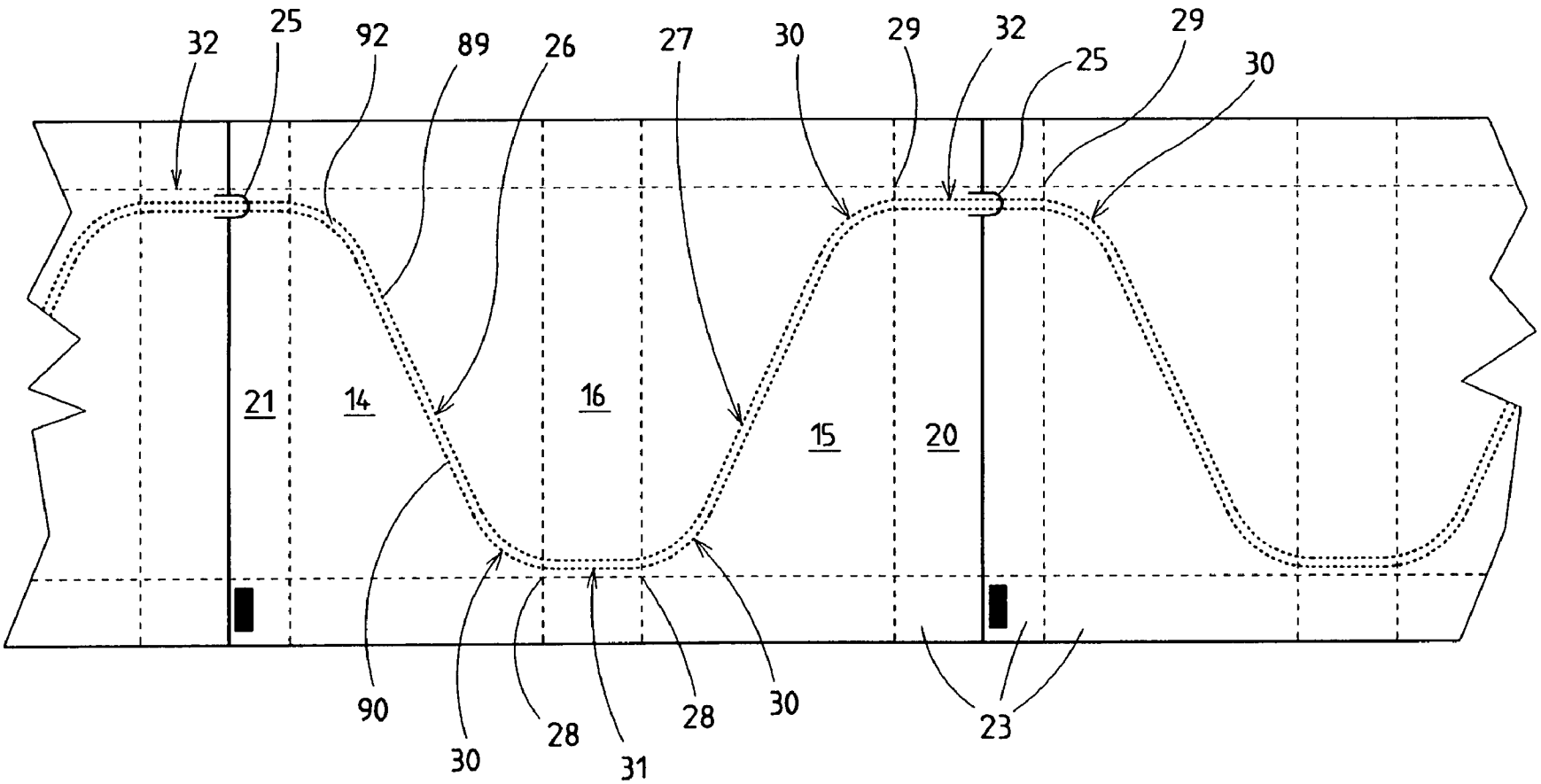
FIG. 18 shows a section of a (film) web) with a continuous weakened line according to FIG. 2.
Figure 19:
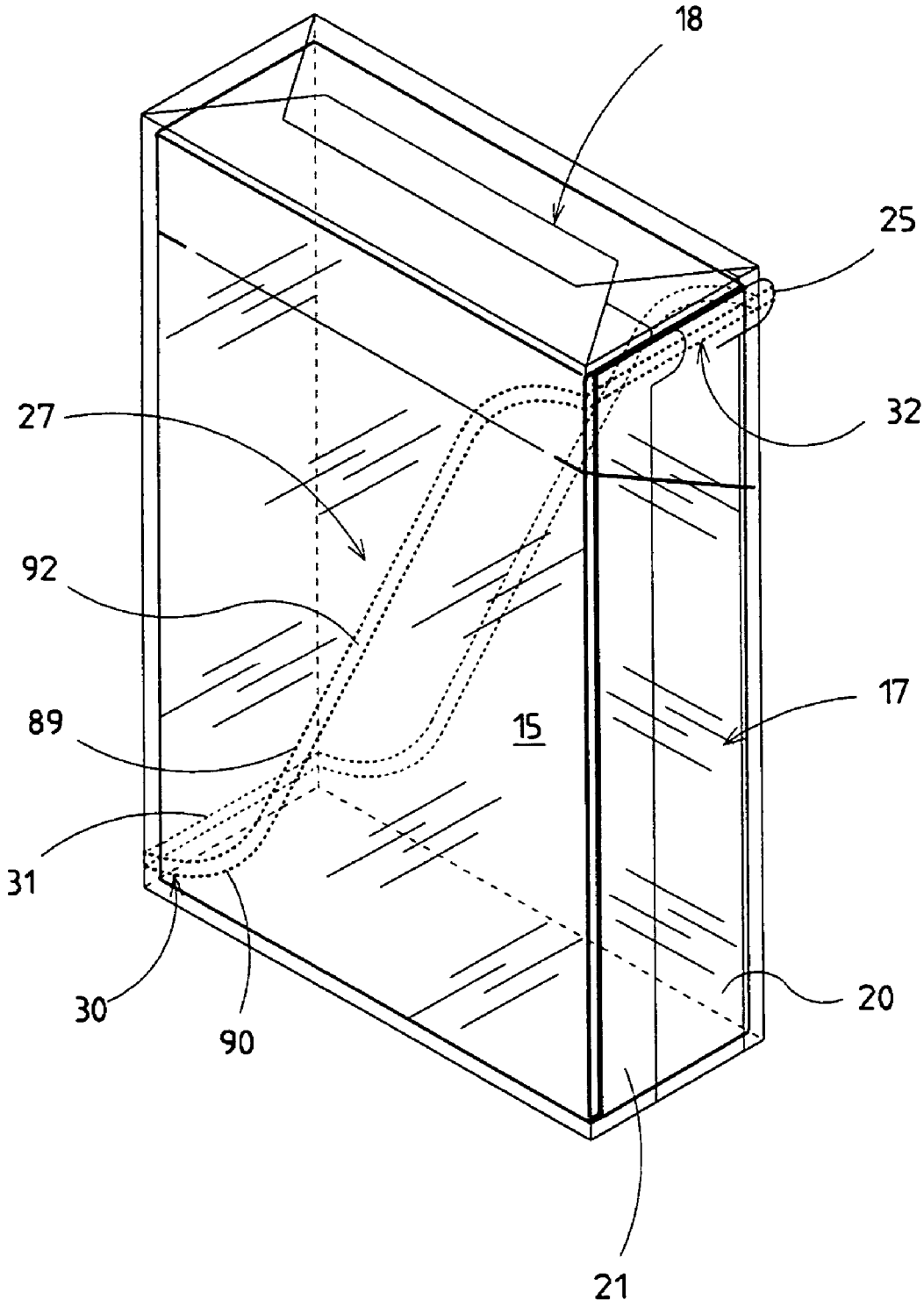
FIG. 19 shows a perspective view of a cigarette pack of the hinge-lid type with an outer wrapper made from a film web pursuant to FIG. 18.
Figure 20:
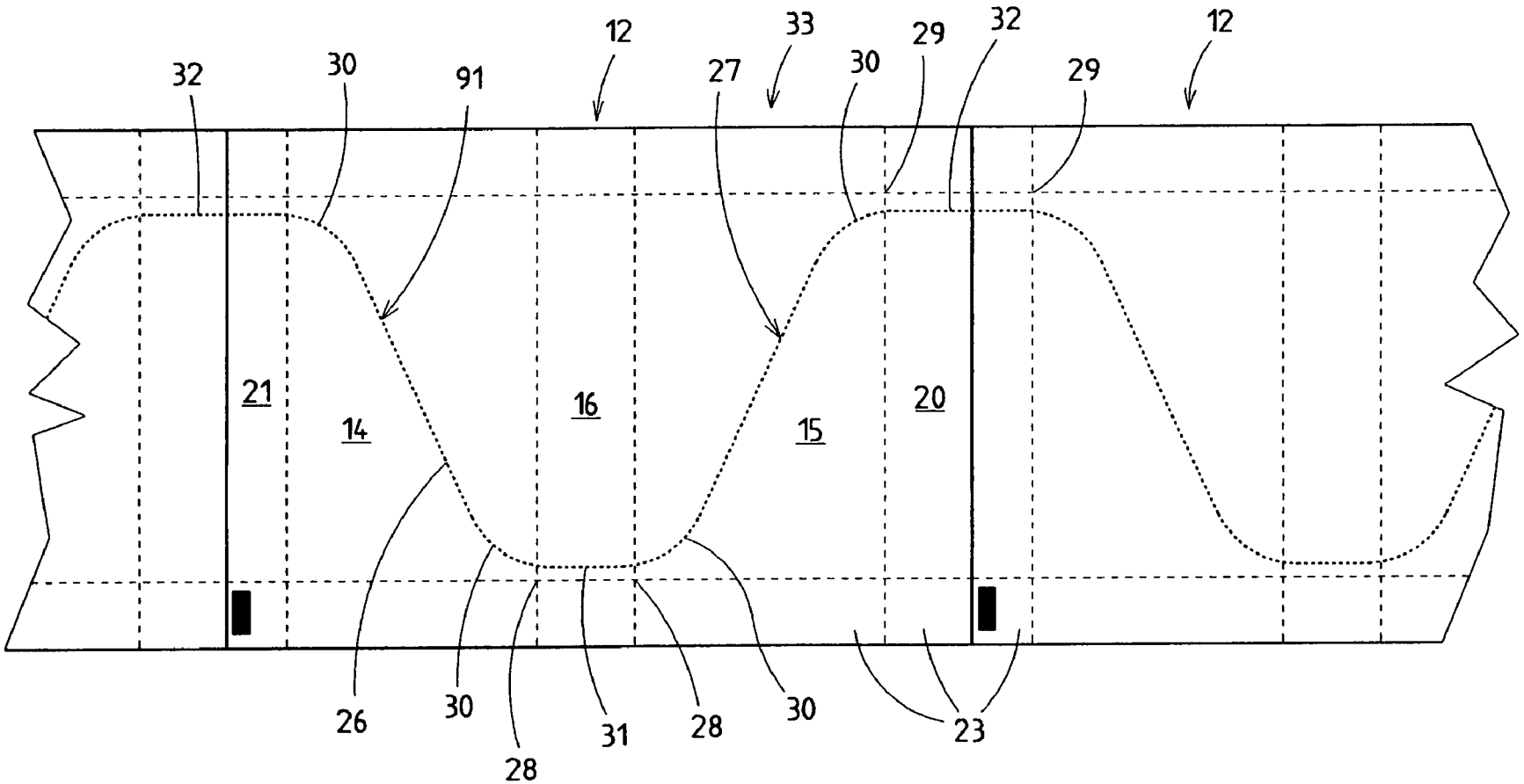
FIG. 20 shows a section of a film web with a single, continuous weakened line.

A particular alternative to the described exemplary embodiments with a tear-open strip is shown in FIG. 18 to FIG. 20. The packaging material itself, i.e. in particular the film for the outer wrapper of the (cigarette) pack is provided with one or more continuous or unbroken weakened lines 89, 90 or 91. These represent a linear weakening of the wall thickness of the packaging material while, however, maintaining (at the inner side) a tight and continuously closed film. The cross-sectional weakening or the thereby created weakened line 89, 90, 91 facilitates an easy, manual severing of the film in this region. Preferably the weakened lines 89, 90, 91 are applied by means of laser technology. A laser beam can be controlled with such precision that it is possible to create a linear weakening of material even in the case of films having a very thin wall thickness. The course of the one or more weakened lines 89, 90, 91 corresponds to the course of the tear-open thread 24 in the previous exemplary embodiments, whereby the sub-parts of the tear-off thread designated as the thread section are here the line sections of the weakened line 89, 90, 91.

In the exemplary embodiment pursuant to FIG. 18 and FIG. 19, two parallel weakened lines 89, 90 are provided as continuous lines. The two weakened lines 89, 90 run parallel to and at a small distance from one another, with the result that a material strip 92 is created between the two weakened lines. Said material strip 92 can be pulled by hand from the walls of the outer wrapper or of the blank 12 in the manner of a tear-off strip. Provided here—analogous to the exemplary embodiment pursuant to FIG. 2—is a grip tab 25 which facilitates the tear-open process. The shape and course of the weakened lines 89, 90 corresponds to the described exemplary embodiments.

FIG. 20 shows a special embodiment having a single weakened line 91, which is preferably produced by laser as well. This weakened line is severed by pulling apart (manually) the adjacent regions of the film or of the blank 12, i.e. without the use of a tear-open tab.

In the laser-assisted production of the weakened lines 89, 90 or 91, the web 33, which is conveyed in the longitudinal direction preferably in a continuous manner, has above it a laser which can be moved transversely relative to the web 33 in a controlled manner and in agreement with the conveying movement of the web 33 such that is the desired formation of the weakened lines 89, 90, 91 is generated. The device for moving the laser head can be configured analogously to FIG. 5 and FIG. 7.

LIST OF DESIGNATIONS

10 Hinge-lid box
11 Cigarette multipack
12 Blank
13 Blank
14 Front wall
15 Rear wall
16 Side wall
17 Side wall
18 End wall
19 Base wall
20 Side flap
21 Side flap
22 End flap
23 End flap
24 Tear-open thread
25 Grip tab
26 Thread section
27 Thread section
28 Pack corner
29 Pack corner
30 Rounded portion
31 Thread section
32 Thread section
33 Web
34 Blank subassembly
35 Guide roller
36 Supporting roller
37 Compensating disk
38 Reel
39 Thread unit
40 Thread reel
41 Compensating roller
42 Gear unit
43 Gear unit
44 Dancer roller
45 Carrier
46 Slot guide
47 Deflecting roller
48 Deflecting roller
49 Servomotor
50 Crank mechanism
51 Connecting rod
52 Crank
53 Guide carriage
54 Transverse guide
55 Tie rod
56 Carrying component
57 Mount
58 Connecting rod
59 Articulation
60 Pivoting arm
61 Individual roller
62 Individual roller
63 Individual roller
64 Carrying spindle
65 Deflecting roller
66 Pivoting arm
67 Compression spring
68 Severing cut
69 Thread cutter
70 Thread cutter
71 Thread web
72 Thread web
73 Cutting block
74 Guide
75 Guide roller
76 Guide roller
77 Mating cutter
78 Recess
79 Suction bore
80 Guide slot
81 Pressure-exerting component
82 Web section
83 Compensating pendulum arrangement
84 Compensating pendulum arrangement
85 Bar
86 Carrying arm
87 Slot
88 Deflecting roller
89 Weakened line
90 Weakened line
91 Weakened line
92 Material strip

The invention claimed is:

1. A cuboidal pack having an outer wrapper made of film or other tearable packaging material, and having a continuous tear-open thread (24) or a continuous weakened line (89, 90, 91) fitted on the outer wrapping for severing the latter when opened for the first time, characterized by the following features:

a) each of two thread sections (26, 27) of the continuous tear-open thread (24), or each of two line sections of the continuous weakend line in a region of a pack front wall (14) and a pack rear wall (15), is directed approximately diagonally from a bottom pack corner (28) to a diagonally opposite top pack corner (29);

b) the thread sections (26, 27) or line sections running in the regions of the front wall (14) and the rear wall (15) are joined in a region of narrow pack side walls (16, 17) by transversely directed, rectilinear thread sections (31, 32) or transversely directed rectilinear line sections comprising a thread section (31 ) or line section immediately adjacent to a pack base wall (19), and a thread section (32) or line section immediately adjacent to a pack end wall (18); and c) in a region, of the front wall (14) and the rear wall (15), adjacent to pack corners (39), the thread sections (26, 27) or line sections each form a rounded portion (30) as a transition from the approximately diagonally directed thread sections (26, 27) or line sections to the transversely directed, rectilinear thread sections (31, 32) or line sections of the side walls (16, 17).

* * * * *